US007452092B2

(12) United States Patent
Vanderschuit

(10) Patent No.: US 7,452,092 B2
(45) Date of Patent: Nov. 18, 2008

(54) ILLUMINATED IMPLEMENTS FOR DRINKING AND/OR EATING AND RELATED METHODS

(76) Inventor: Carl R. Vanderschuit, 751 Turquoise St., San Diego, CA (US) 92109

( * ) Notice: Subject to any disclaimer, the term of this patent is extended or adjusted under 35 U.S.C. 154(b) by 115 days.

(21) Appl. No.: 11/483,442

(22) Filed: Jul. 10, 2006

(65) Prior Publication Data

US 2006/0291191 A1 Dec. 28, 2006

Related U.S. Application Data

(63) Continuation-in-part of application No. 10/851,510, filed on May 21, 2004, now Pat. No. 7,073,917, and a continuation-in-part of application No. 10/961,364, filed on Oct. 8, 2004, now Pat. No. 7,311,411, and a continuation-in-part of application No. 11/442,625, filed on May 26, 2006, which is a continuation-in-part of application No. 10/606,314, filed on Jun. 25, 2003, now Pat. No. 7,052,154.

(60) Provisional application No. 60/510,778, filed on Oct. 10, 2003.

(51) Int. Cl.
*F21V 33/00* (2006.01)

(52) U.S. Cl. ..... 362/96; 362/101; 362/562

(58) Field of Classification Search ..... 362/562, 362/101, 96

See application file for complete search history.

(56) References Cited

U.S. PATENT DOCUMENTS 1,982,315 A 11/1934 Lundberg (Continued)

FOREIGN PATENT DOCUMENTS

CH 662931 11/1987

(Continued)

OTHER PUBLICATIONS http://www.highcaliberline.com/productdesp.php?cid=20&scid=2&fcid=0&pid=T-901, 902 and 903, 9 pages, accessed Sep. 20, 2007.

(Continued)

*Primary Examiner*—Sandra L. O'Shea
*Assistant Examiner*—William J Carter
(74) *Attorney, Agent, or Firm*—Harness, Dickey & Pierce, P.L.C.

(57) ABSTRACT

According to various aspects, exemplary embodiments are provided of illuminated implements for drinking and/or eating and related methods. In various embodiments, an implement for drinking and/or eating generally includes at least one tube having at least one inner fluid flow passage therethrough in which fluid may be received and delivered through the at least one inner fluid flow passage. At least one power source has at least a portion situated in the at least one inner fluid flow passage such that fluid may be received in and drawn through the at least one inner fluid flow passage generally around and past the at least a portion of the at least one power source situation in the at least one inner fluid flow passage. The implement also includes at least one light source that is at least partially within the at least one tube and electrically-powered by the at least one power source.

45 Claims, 7 Drawing Sheets

U.S. PATENT DOCUMENTS

| | | | | |
|---|---|---|---|---|
| 2,521,449 | A | | 9/1950 | Cossa |
| 2,663,866 | A | | 12/1953 | Simpson |
| 3,845,291 | A | | 10/1974 | Portyrata |
| 4,124,881 | A | | 11/1978 | Haber et al. |
| 4,181,304 | A | | 1/1980 | Haber |
| 4,231,079 | A | | 10/1980 | Heminover |
| 4,252,273 | A | * | 2/1981 | Karterman ..... 239/33 |
| 4,564,889 | A | | 1/1986 | Bolson |
| 4,570,206 | A | | 2/1986 | Deutsch |
| 4,716,902 | A | | 1/1988 | Swartz |
| 4,749,126 | A | | 6/1988 | Kessener et al. |
| 4,901,211 | A | | 2/1990 | Shen |
| 4,914,748 | A | | 4/1990 | Schlotter, IV et al. |
| 5,010,461 | A | | 4/1991 | Saotome |
| 5,070,435 | A | * | 12/1991 | Weller ..... 362/101 |
| 5,119,279 | A | | 6/1992 | Makowsky |
| 5,177,812 | A | | 1/1993 | DeMars |
| 5,211,699 | A | | 5/1993 | Tipton |
| 5,339,548 | A | | 8/1994 | Russell |
| 5,404,593 | A | | 4/1995 | Kronenberger |
| 5,471,373 | A | | 11/1995 | Coleman et al. |
| 5,485,358 | A | | 1/1996 | Chien |
| 5,510,961 | A | | 4/1996 | Peng |
| 5,545,069 | A | | 8/1996 | Glynn et al. |
| 5,575,553 | A | | 11/1996 | Tipton |
| 5,647,064 | A | | 7/1997 | Whittaker |
| 5,667,294 | A | | 9/1997 | Lo |
| 5,676,449 | A | | 10/1997 | Newsome |
| 5,676,988 | A | | 10/1997 | Coleman et al. |
| 5,741,060 | A | | 4/1998 | Johnson |
| 5,758,947 | A | | 6/1998 | Glatt |
| 5,784,265 | A | | 7/1998 | Chen |
| 5,785,407 | A | | 7/1998 | Ratcliffe et al. |
| 5,809,678 | A | | 9/1998 | Douglas |
| 5,871,271 | A | | 2/1999 | Chien |
| 5,879,068 | A | | 3/1999 | Menashrov et al. |
| 5,921,674 | A | | 7/1999 | Koczi |
| 5,931,383 | A | | 8/1999 | Palmer et al. |
| 5,931,559 | A | | 8/1999 | Pfaeffle |
| 6,002,079 | A | | 12/1999 | Shin et al. |
| 6,021,960 | A | | 2/2000 | Kehat |
| 6,032,293 | A | | 3/2000 | Makki |
| 6,044,495 | A | | 4/2000 | Ellman et al. |
| 6,054,156 | A | * | 4/2000 | Rudell et al. ..... 426/104 |
| 6,082,866 | A | | 7/2000 | Amedee |
| 6,097,287 | A | | 8/2000 | Lu |
| 6,113,244 | A | | 9/2000 | Baumgartner |
| 6,113,886 | A | | 9/2000 | Bryan |
| 6,116,745 | A | | 9/2000 | Yei |
| 6,126,290 | A | | 10/2000 | Veigel |
| 6,135,606 | A | | 10/2000 | Fernandez et al. |
| 6,168,286 | B1 | | 1/2001 | Duffy |
| 6,213,616 | B1 | | 4/2001 | Chien |
| 6,254,247 | B1 | | 7/2001 | Carson |
| 6,273,580 | B1 | | 8/2001 | Coleman et al. |
| 6,286,974 | B1 | | 9/2001 | Rochel et al. |
| 6,325,521 | B1 | | 12/2001 | Gregg et al. |
| 6,325,693 | B1 | | 12/2001 | Rudell et al. |
| 6,354,711 | B1 | | 3/2002 | McCoy |
| D455,539 | S | | 4/2002 | Kates |
| 6,416,198 | B1 | | 7/2002 | VanderSchuit |
| 6,416,800 | B1 | | 7/2002 | Weber et al. |
| 6,439,472 | B1 | | 8/2002 | Lin et al. |
| 6,499,145 | B1 | | 12/2002 | Kates |
| 6,572,244 | B1 | | 6/2003 | Clark |
| 6,615,520 | B2 | | 9/2003 | Landers et al. |
| 6,619,816 | B1 | | 9/2003 | Johnson |
| 6,637,676 | B2 | | 10/2003 | Zieger et al. |
| 6,641,280 | B2 | | 11/2003 | Hanson et al. |
| 6,659,618 | B2 | | 12/2003 | Waters |
| 6,721,962 | B1 | | 4/2004 | Polaire |
| 6,733,150 | B1 | | 5/2004 | Hanley |
| 6,761,468 | B1 | | 7/2004 | Bogal |
| 6,824,289 | B2 | | 11/2004 | VanderSchuit |
| 6,874,909 | B2 | | 4/2005 | VanderSchuit |
| 6,935,761 | B2 | | 8/2005 | VanderSchuit |
| 6,955,450 | B2 | | 10/2005 | Johnson |
| D520,292 | S | | 5/2006 | Oas |
| 7,052,154 | B2 | | 5/2006 | VanderSchuit |
| 7,052,167 | B2 | | 5/2006 | VanderSchuit |
| 2003/0026088 | A1 | | 2/2003 | VanderSchuit |
| 2003/0151910 | A1 | | 8/2003 | Marston |
| 2004/0004830 | A1 | | 1/2004 | Rudell et al. |
| 2004/0136177 | A1 | | 7/2004 | Lews et al. |
| 2004/0233674 | A1 | | 11/2004 | VanderSchuit |
| 2004/0264187 | A1 | | 12/2004 | VanderSchuit |
| 2005/0052883 | A1 | | 3/2005 | Qi et al. |
| 2005/0115118 | A1 | | 6/2005 | Marston |

FOREIGN PATENT DOCUMENTS

| | | |
|---|---|---|
| DE | 299 18 185 | 1/2000 |
| EP | 0 231 471 | 8/1987 |
| GB | 2381575 | 5/2003 |
| GB | 2 392 973 | 3/2004 |
| WO | WO 93/18358 | 9/1993 |
| WO | WO 02/10642 | 2/2002 |
| WO | WO 2004/005796 | 1/2004 |
| WO | WO 2005/002378 | 1/2005 |

OTHER PUBLICATIONS

United Kingdom Combined Search and Examination Report dated Jan. 6, 2004; Application No. GB 03265493.4; 4 pages.

Supplementary European Search Report dated Mar. 1, 2004; App. No. EP 01 93 9305; 3 pages.

European Examination Report dated May 13, 2004; Application No. EP 01 939 305.7, 2 pages.

International Search Report dated Oct. 28, 2005; PCT Application No. PCT/US05/18151; 3 pages.

Written Opinion dated Oct. 28, 2005; PCT Application No. PCT/US05/18151; 6 pages.

* cited by examiner

ILLUMINATED IMPLEMENTS FOR DRINKING AND/OR EATING AND RELATED METHODS

CROSS-REFERENCE TO RELATED APPLICATIONS

This application is continuation-in-part of allowed U.S. patent application Ser. No. 10/851,510 filed May 21, 2004.

This application is also a continuation-in-part of U.S. patent application Ser. No. 10/961,364 filed Oct. 8, 2004, which, in turn, claimed priority to U.S. Provisional Application 60/510,778 filed Oct. 10, 2003.

This application is also a continuation-in-part of U.S. patent application Ser. No. 11/442,625 filed May 26, 2006, which, in turn, is a continuation-in-part of U.S. patent application Ser. No. 10/606,314 filed Jun. 25, 2003 (now U.S. Pat. No. 7,052,154, Issued May 30, 2006).

The disclosures of the above applications are incorporated herein by reference.

FIELD

The present disclosure relates generally to implements for use in connection with drinking or eating and, more particularly, to illuminated implements for use in consuming beverages and/or food.

BACKGROUND

The statements in this section merely provide background information related to the present disclosure and may not constitute prior art.

Eating and drinking are often associated with entertainment and enjoyment. For example, both adults and children may associate attending parties, picnics, outings, and other recreational activities with drinking beverages and/or eating frozen treats on sticks. Accordingly, it is desirable to heighten the enjoyment associated with eating and drinking.

SUMMARY

In various embodiments, an implement for drinking and/or eating generally includes at least one tube having at least one inner fluid flow passage therethrough in which fluid may be received and delivered through the at least one inner fluid flow passage. At least one power source has at least a portion situated in the at least one inner fluid flow passage such that fluid may be received in and drawn through the at least one inner fluid flow passage generally around and past the at least a portion of the at least one power source situation in the at least one inner fluid flow passage. The implement also includes at least one light source that is at least partially within the at least one tube and electrically-powered by the at least one power source.

In other exemplary embodiments, an implement for use in connection with drinking and/or eating generally includes first and second tubes. The first tube has at least one inner fluid flow passage therethrough in which fluid may be received and delivered through the at least one inner fluid flow passage. The second tube has at least one inner cavity therein. At least a portion of the second tube is situated in the at least one inner fluid flow passage such that fluid may be received in and drawn through the at least one inner fluid flow passage generally around and past the at least a portion of the second tube in the at least one inner fluid flow passage. At least one light source is at least partially positioned within the at least one inner cavity of the second tube. At least one housing is configured to receive at least one power source therein for electrically powering the at least one light source. At least a portion of the at least one housing is situated in the at least one inner fluid flow passage such that fluid may be received in and drawn through the at least one inner fluid flow passage generally around and past the at least a portion of the at least one housing in the at least one inner fluid flow passage.

Additional exemplary embodiments of an implement for use in connection with drinking and/or eating generally include first and second tubes. The first tube has at least one inner fluid flow passage therethrough in which fluid may be received and delivered through the at least one inner fluid flow passage. The second tube has at least one inner cavity therein. The second tube is situated in the at least one inner fluid flow passage such that fluid may be received in and drawn through the at least one inner fluid flow passage generally around and past the second tube in the at least one inner fluid flow passage. At least one light source is within the at least one inner cavity of the second tube. At least one housing is configured to receive at least one power source therein for electrically powering the at least one light source. The at least one housing is coupled to the second tube such that the interface between the at least one housing and the second tube is substantially sealed. The at least one housing is situated in the at least one inner fluid flow passage such that fluid may be received in and drawn through the at least one inner fluid flow passage generally around and past the at least one housing in the at least one inner fluid flow passage. At least one electrically-conductive lead extends from the at least one light source through at least a portion of the at least one inner cavity of the second tube to the at least one housing for electrically connecting the at least one light source to the at least one power source within the at least one housing.

In further exemplary embodiments, an implement for use in connection with drinking and/or eating, the implement generally includes at least one light source and at least one tube having at least one inner fluid flow passage therethrough in which fluid may be received and delivered through the at least one inner fluid flow passage. At least one housing is rotatably mounted to the tube for rotation in the at least one inner fluid flow passage. The at least one housing includes at least one blade extending into the at least one inner fluid flow passage and configured such that at least a portion of fluid received in and drawn through the at least one inner fluid flow passage contacts the at least one blade for causing rotation of the at least one housing. The implement also includes at least one electrical generator for generating electrical power for operating the at least one light source. The at least one electrical generator includes at least one stator within the at least one housing, and at least one rotor within the at least one stator. The at least one rotor is coupled to the at least one housing for common rotation therewith.

Further aspects and features of the present disclosure will become apparent from the detailed description provided hereinafter. In addition, any one or more aspects of the present disclosure may be implemented individually or in any combination with any one or more of the other aspects of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
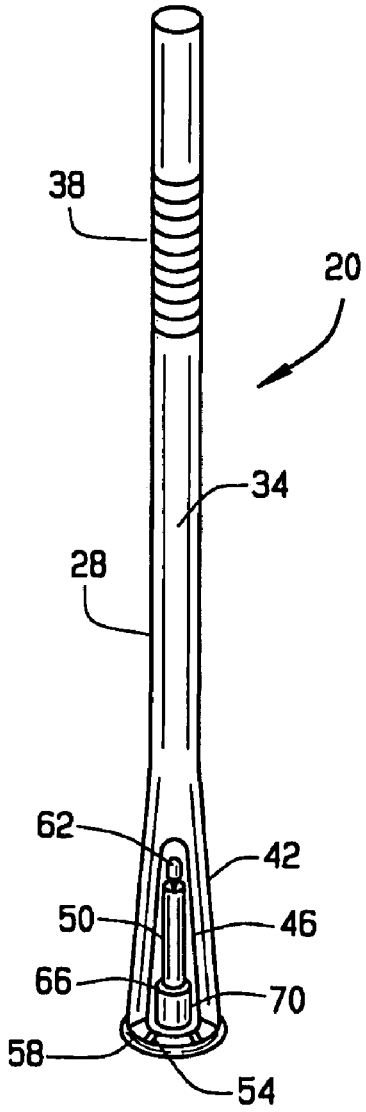
FIG. 1 is a perspective view of an implement for use in connection with drinking and/or eating in accordance with an exemplary embodiment.

The following description is merely exemplary in nature and is in no way intended to limit the present disclosure, application, or uses. Various configurations or embodiments are not necessarily drawn to scale in the figures.

In various embodiments, an implement for drinking and/or eating generally includes at least one tube having at least one inner fluid flow passage therethrough in which fluid may be received and delivered through the at least one inner fluid flow passage. At least one power source has at least a portion situated in the at least one inner fluid flow passage such that fluid may be received in and drawn through the at least one inner fluid flow passage generally around and past the at least a portion of the at least one power source situation in the at least one inner fluid flow passage. The implement also includes at least one light source that is at least partially within the at least one tube and electrically-powered by the at least one power source.

In any one or more of these various embodiments, one or more of the following features may also be included. For example, there may be at least one housing for the at least one power source positioned within the at least one inner fluid flow passage. The at least one light source can be situated within the at least one housing such that fluid may be received in and drawn through the at least one inner fluid flow passage past the at least one light source within the at least one housing.

The at least one tube can include a surface defining the at least one inner fluid flow passage, and the implement can further include one or more spokes attaching the at least one housing to the tube surface defining the at least one inner fluid flow passage such that the at least one housing is spaced apart from the tube surface defining the at least one inner fluid flow passage. The one or more spokes can be configured such that the at least one housing is generally centrally positioned within the at least one inner fluid flow passage along a longitudinal centerline axis of the at least one inner fluid flow passage. Or, for example, the at least one tube can include a surface defining the at least one inner fluid flow passage, and the at least one housing can be attached directly to the tube surface defining the at least one inner fluid flow passage such that the at least one housing is situated asymmetrically within the at least one inner fluid flow passage.

The at least one power source can be situated entirely in the at least one inner fluid flow passage such that fluid may be received in and drawn through the at least one inner fluid flow passage generally around and past the at least one power source. The at least one tube may include at least one sidewall in which is positioned one or more light sources.

The at least one tube may include inner and outer surfaces defining one or more chambers in a sidewall of the at least one tube. A substance may be disposed in at least one of the one or more chambers, such as at least one or more of a gel, a light-altering material, a hot/cold gel, a colored substance, a fluorescent substance, a glow-in-the-dark substance, combinations thereof, etc. At least one optical fiber may extend into at least one of the one or more chambers such that light from at least one LED is transmitted through the at least one optical fiber.

The implement may include at least one housing rotatably mounted to the at least one tube for rotation in the at least one inner fluid flow passage. By way of example, the at least one housing can include at least one blade extending into the at least one inner fluid flow passage and configured such that at least a portion of fluid received in and drawn through the at least one inner fluid flow passage contacts the at least one blade for causing rotation of the at least one housing. At least one light source and/or power source may be disposed within and rotatable along with the at least one housing. The implement can be configured such that rotation of the at least one housing generates electrical power for operating the at least one light source.

One or more light sources may be provided within the at least one inner fluid flow passage such that fluid may be received in and drawn through the at least one inner fluid flow passage past the one or more light sources within the at least one inner fluid flow passage.

The at least one tube can include at least one light-transmissive portion. At least one light source can be positioned for directing light at the at least one light-transmissive portion through which at least some of said light is transmissible and visually perceptible to an observer, whereby the cosmetic appearance of the implement can be enhanced.

The implement can include one or more indicia highlighted by light from at least one light source. The one or more indicia may be responsive to black light, which are highlighted by black light from at least one light source. The implement may include one or more indicia that are etched, integrally formed at an acute angle relative to a direction at which light is emitted by at least one light source, and/or printed. At least a portion of the at least one tube is responsive to black light that is highlighted by black light from at least one light source.

At least one light source can be housed within at least one housing slidably retained within the at least one inner fluid flow passage such that at least a portion of fluid received in and drawn through the at least one inner fluid flow passage causes slidable movement of the at least one housing and the at least light source housed therein within the at least one inner fluid flow passage. The at least one inner fluid flow passage can include first and second portions spaced apart from each other at which the at least inner fluid flow passage is smaller in size. The at least one housing and the at least one light source housed therein can be slidably retained within the at least one inner fluid flow passage between the first and second portions. The implement may include electrical terminals external to the at least one housing for electrically-connecting connecting the at least one light source to the at least one power source when the fluid within the at least one inner fluid flow passage electrically connects the terminals to each other.

In other exemplary embodiments, an implement for use in connection with drinking and/or eating generally includes first and second tubes. The first tube has at least one inner fluid flow passage therethrough in which fluid may be received and delivered through the at least one inner fluid flow passage. The second tube has at least one inner cavity therein. At least a portion of the second tube is situated in the at least one inner fluid flow passage such that fluid may be received in and drawn through the at least one inner fluid flow passage generally around and past the at least a portion of the second tube in the at least one inner fluid flow passage. At least one light source is at least partially positioned within the at least one inner cavity of the second tube. At least one housing is configured to receive at least one power source therein for electrically powering the at least one light source. At least a portion of the at least one housing is situated in the at least one inner fluid flow passage such that fluid may be received in and drawn through the at least one inner fluid flow passage generally around and past the at least a portion of the at least one housing in the at least one inner fluid flow passage.

In any one or more of the various embodiments, one or more of the following features may also be included. At least a portion of the at least one housing may be attached to the first tube. For example, the at least one housing can include generally opposing end portions and generally opposing side portions. The housing's end portions can be attached to the first tube with the housing's side portions a spaced distance away from the first tube such that fluid may be received in and drawn through the spaced distance separating the housing's side portions from the first tube. The at least one housing can be attached to an open end of the second tube such that the interface between the at least one housing and the open end of the second tube is substantially sealed.

The at least one housing can be situated entirely in the at least one inner fluid flow passage of the first tube. The second tube can be situated entirely in the at least one inner fluid flow passage of the first tube. The at least one light source can be situated entirely within the at least one inner cavity of the second tube. The implement may further include at least one electrically-conductive lead extending from the at least one light source through at least a portion of the at least one inner cavity of the second tube to the at least one housing for electrically connecting the at least one light source to the at least one power source within the at least one housing. The implement may include at least one substrate to which the at least one electrically-conductive lead is coupled, and at least a portion of the substrate can be situated within the at least one inner cavity of the second tube. The implement can also include at least one ribbon cable having at least a portion situated within the at least one inner cavity of the second tube, wherein the at least one light source comprises at least one LED mounted to the at least one ribbon cable, and wherein at least a portion of the electrically-conductive lead is mounted to the at least one ribbon cable. Depending on the particular application, the implement may be operatively connected with a drinking straw.

Additional exemplary embodiments of an implement for use in connection with drinking and/or eating generally include first and second tubes. The first tube has at least one inner fluid flow passage therethrough in which fluid may be received and delivered through the at least one inner fluid flow passage. The second tube has at least one inner cavity therein. The second tube is situated in the at least one inner fluid flow passage such that fluid may be received in and drawn through the at least one inner fluid flow passage generally around and past the second tube in the at least one inner fluid flow passage. At least one light source is within the at least one inner cavity of the second tube. At least one housing is configured to receive at least one power source therein for electrically powering the at least one light source. The at least one housing is coupled to the second tube such that the interface between the at least one housing and the second tube is substantially sealed. The at least one housing is situated in the at least one inner fluid flow passage such that fluid may be received in and drawn through the at least one inner fluid flow passage generally around and past the at least one housing in the at least one inner fluid flow passage. At least one electrically-conductive lead extends from the at least one light source through at least a portion of the at least one inner cavity of the second tube to the at least one housing for electrically connecting the at least one light source to the at least one power source within the at least one housing.

In further exemplary embodiments, an implement for use in connection with drinking and/or eating, the implement generally includes at least one light source and at least one tube having at least one inner fluid flow passage therethrough in which fluid may be received and delivered through the at least one inner fluid flow passage. At least one housing is rotatably mounted to the tube for rotation in the at least one inner fluid flow passage. The at least one housing includes at least one blade extending into the at least one inner fluid flow passage and configured such that at least a portion of fluid received in and drawn through the at least one inner fluid flow passage contacts the at least one blade for causing rotation of the at least one housing. The implement also includes at least one electrical generator for generating electrical power for operating the at least one light source. The at least one electrical generator includes at least one stator within the at least one housing, and at least one rotor within the at least one stator. The at least one rotor is coupled to the at least one housing for common rotation therewith.

In some of these embodiments, one or more light sources can be within the at least one inner fluid flow passage such that fluid may be received in and drawn through the at least one inner fluid flow passage past the one or more light sources within the at least one inner fluid flow passage. In addition, at least one rim can be rotatably mounted to the at least one tube, and at least one spoke can be used for attaching the at least one housing to the at least one rim for common rotation therewith.

Referring now to FIG. 1, there is shown an exemplary configuration of an implement 20 for use in connection with drinking and/or eating. As shown in FIG. 1, the implement 20 includes a tube 28 having a passage 34 therethrough. The tube is fabricated, for example, of plastic and the implement 20 can be used, for example, as a drinking straw. At least a portion of the tube 28 is transparent and/or translucent.

The tube 28 may be rigid at least in part and/or flexible at least in part. For example, a corrugated portion 38 of the tube 28 is flexible, although other ways of providing flexibility could also be used. For example, at least a portion of the tube 28 may have a thickness and/or density that allows the tube to be flexed in such portion. The tube 28 and/or passage 34 may vary with respect to width. For example, as shown in FIG. 1, a bottom portion 42 of the tube 28 is flared in shape. Tube and passage widths may also vary with respect to one another, as further described below.

A housing 46 for a power source 50 is situated in the passage 34 such that a fluid may be drawn through the passage 34 past the housing 46 and power source 50. For example, the housing 46 may be attached by one or more spokes 54 to a lower end 58 of the tube. Thus, for example, a beverage being sucked by a user through the implement 20 flows around the spoke(s) 54 into the tube 28. In another configuration, the housing 46 may be situated asymmetrically in the passage 34, for example, attached directly to the tube 28, thereby reducing or eliminating any need for spoke(s). The housing 46 may be fabricated of plastic and may be at least partly transparent and/or translucent. The housing 46 and tube 28 preferably are made of non-toxic material(s) that remain suitable for contact with consumables when heated and/or frozen.

The implement 20 also includes one or more light sources 62 in the tube 28 powered by the power source 50. The light source(s) 62 may include, for example, one or more light-emitting diodes (LEDs), optical fibers, and/or electroluminescent wires. However, any type of suitable light source may be used. As shown in FIG. 1, the light source 62 includes a LED electrically connected with the power source 50, e.g., a battery or battery pack inside the housing 46. The power source 50 may include an optional control chip 66 for providing blinking, strobing and/or other effects and is operable using a switch 70. The switch 70 may be button-activated, water-activated, touch-activated, twist-activated, temperature-activated, pressure-activated, or activated using other means. Various known switches may be used. Exemplary switches include push-button switches, motion-responsive ball-switch, temperature sensitive switches, magnetic switches, mechanical switches, electrical switches, translating-type switch mechanisms, reciprocating switch, manually-operated switches, automatically-operated switches, combinations thereof, etc.

To use the implement 20, a user may activate the switch 70 to switch on the power source 50 and light source(s) 62. In one configuration wherein the switch 70 is liquid-activated, the switch 70 is activated when the user inserts the lower end 58 of the implement 20, for example, into a beverage. The switch 70 may be subsequently deactivated when the implement 20 is removed from the beverage. In another example embodiment, the switch 70 may be a temperature sensitive switch that automatically activates when the user inserts the lower end 58 of the implement 20 into a liquid (e.g., cool or hot beverage) having a temperature that causes the temperature sensitive switch to automatically activate. The switch 70 may then be subsequently deactivated when the implement 20 is removed from the cool beverage.

When the light source 62 is activated, light may pass through the housing 46 and tube 28. Where the housing and/or tube are translucent, the light may cause the housing and/or tube to glow. It can be appreciated that a variety of lighting effects can be produced in the implement 20 and/or in a liquid in which the implement 20 is inserted, depending on the transparency and/or translucence of various portions of the tube 28 and/or housing 46.

Figure 2A:
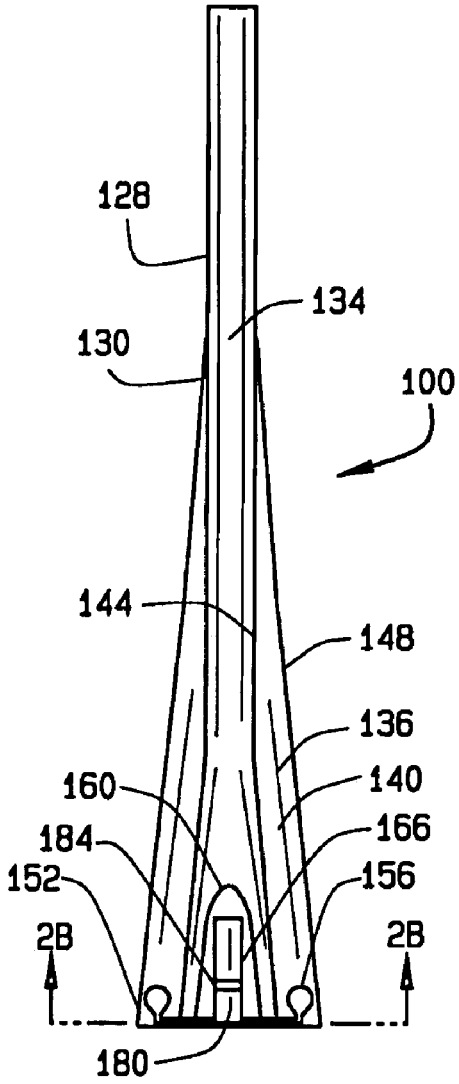
FIG. 2A is a longitudinal sectional view of an implement for use in connection with drinking and/or eating in accordance with another exemplary embodiment.
Figure 2B:
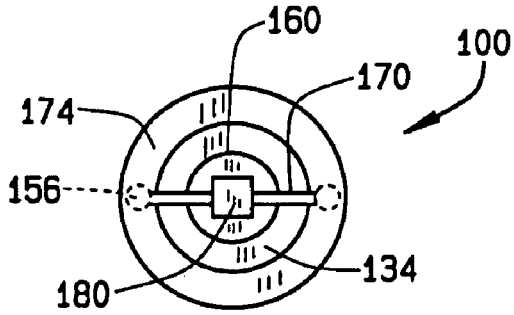
FIG. 2B is a view of the implement shown in FIG. 2A, taken along lines 2B of FIG. 2A.

Another configuration of an implement for use in connection with drinking and/or eating is indicated generally in FIGS. 2A and 2B by reference number 100. The implement 100 includes a tube 128 having a sidewall 130 and a passage 134 therethrough. The tube is fabricated, for example, of plastic. The implement 100 can be used, for example, as a drinking straw, stirrer and/or as a stick for supporting an ice cream bar or other consumable. At least a portion of the tube 128 is transparent and/or translucent. A substance 136, for example, a transparent and/or translucent gel and/or liquid, is sealed in one or more chambers 140 between an inner surface 144 and outer surface 148 of the tube sidewall 130. The substance 136 may include known material(s), e.g., a gel used in reusable freeze packs, and may be colored, fluorescent, glow-in-the-dark and/or the like. The substance 136 and implement 100 preferably are capable of being heated and/or frozen to appropriate temperatures.

The chamber(s) 140 may be tapered and may be sufficient at a lower end 152 of the implement 100 to accommodate one or more light sources 156. Two LEDs 156 are shown in FIGS. 2A and 2B. The chamber(s) 140 could be shaped differently in other configurations. For example, the tube sidewall 130 and chamber(s) 140 could be shaped to form a theme-related or advertisement-related display element as further described below.

A housing 160 for a power source 166 is situated in the passage 134 such that a fluid may be drawn through the passage 134 past the housing 160. For example, the housing 160 may be attached by one or more spokes 170 to a base 174 that seals the chamber 140 and supports the light source(s) 156 at the lower end 152 of the tube. Thus, for example, a beverage being sucked by a user through the implement 100 flows into the tube 128 around the spoke(s) 170. In another configuration, the housing 160 may be situated asymmetrically in the passage 134, for example, attached directly to the tube inner surface 144, thereby reducing or eliminating a need for spoke(s).

The light sources 156 are electrically connected with the power source 166 (e.g., a battery or battery pack inside the housing 160, etc.). The power source 166 is operable using a switch 180 and may include an optional control chip 184 as previously described with reference to FIG. 1.

The implement 100 may be frozen, for example, for use in connection with cold beverages or when used as a support for frozen consumables. Alternatively, the implement 100 can be heated, for example, in connection with hot beverages. Configurations also are contemplated in which other numbers and/or types of light source(s) are provided. For example, the light source(s) 156 may include one or more LEDs, optical fibers, electroluminescent wires, electroluminescent sheeting, combinations thereof, etc. Additionally or alternatively, in one configuration the housing 160 could include an LED or other light source in the same or a similar manner as described with reference to FIG. 1.

Figure 3A:
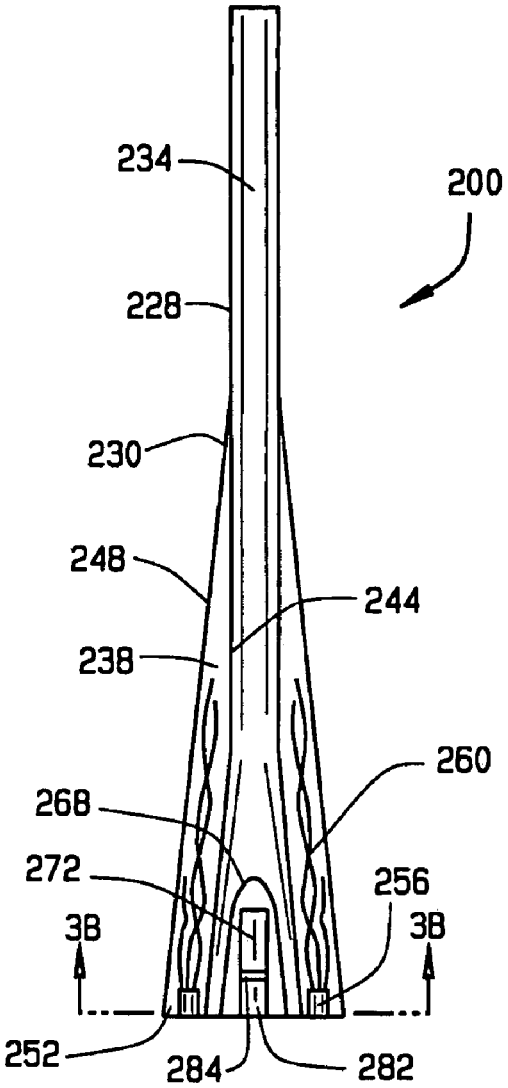
FIG. 3A is a longitudinal sectional view of an implement for use in connection with drinking and/or eating in accordance with another exemplary embodiment.
Figure 3B:
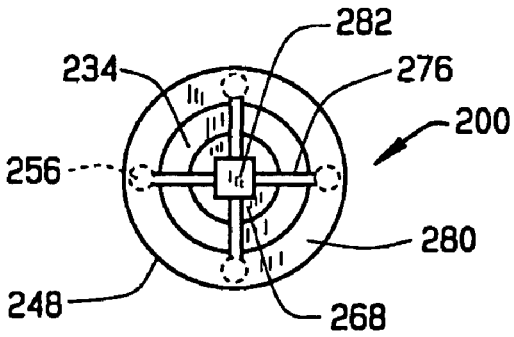
FIG. 3B is a view of the implement shown in FIG. 3A, taken along lines 3B of FIG. 3A.

Another configuration of an implement for use in connection with drinking and/or eating is indicated generally in FIGS. 3A and 3B by reference number 200. The implement 200 includes a tube 228 having a sidewall 230 and a passage 234 therethrough. The tube 228 is fabricated, for example, of plastic. At least a portion of the tube 228 is transparent and/or translucent. One or more chambers 238 may be provided between an inner surface 244 and outer surface 248 of the tube sidewall 230. The chamber(s) 238 may be tapered as shown in FIG. 3A. Other shapes are possible, however, and the distance between inner and outer surfaces 244 and 248 can be varied to provide a desired tube outline and chamber arrangement. For example, the tube 228 and chambers 238 could be shaped to form a theme-related or advertisement-related display element as further described below. As shown in FIGS. 3A and 3B, the chamber 238 is sufficient at a lower end 252 of the implement 200 to accommodate one or more light sources 256. Four light sources 256 (e.g., LEDs, etc.) are shown in FIGS. 3A and 3B. A plurality of optical fibers 260 are gathered and aligned over each LED 256 relative to a focal point of the LED 256 such that light from the LED 256 is transmitted through the fibers 260. The fibers 260 extend into the chamber 238 and may have various lengths. Configurations also are contemplated in which electroluminescent wire is used instead of, or in addition to, the optical fibers 260.

A housing 268 for a power source 272 is situated in the passage 234 such that a fluid may be drawn through the passage 234 past the housing 268. For example, the housing 268 may be attached by one or more spokes 276 to a base 280 that seals the chamber 238 and supports the light source(s) 256 at the lower end 252 of the tube. Thus, for example, a beverage being sucked by a user through the implement 200 flows into the tube 228 around the spoke(s) 276. In another configuration, the housing 268 may be situated asymmetrically in the passage 234, for example, attached directly to the tube inner surface 244, thereby eliminating a need for spoke(s).

The light sources 256 are electrically connected with the power source 272 (e.g., a battery or battery pack inside the housing 268, etc.). The power source 272 is operable using a switch 282 and may include an optional control chip 284 as previously described with reference to FIG. 1.

Figure 4:
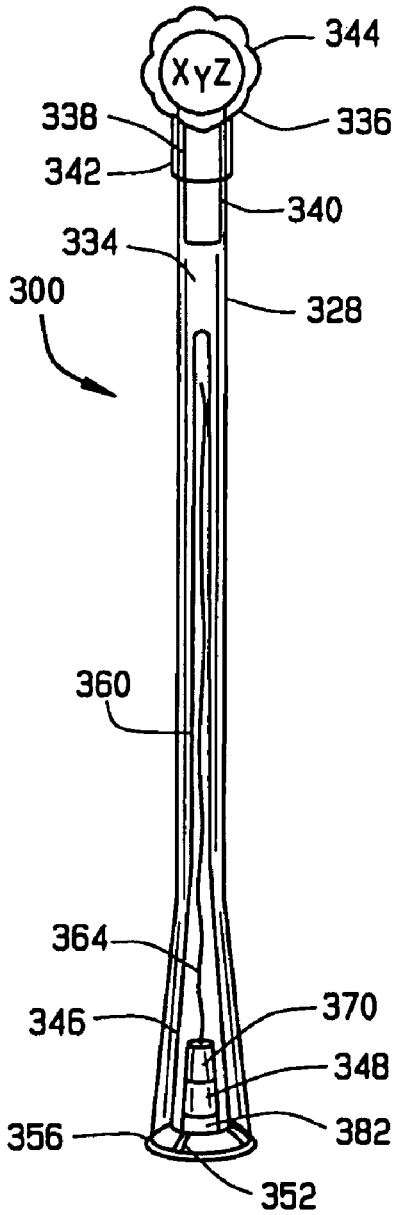
FIG. 4 is a perspective view of an implement for use in connection with drinking and/or eating in accordance with another exemplary embodiment.

Another configuration of an implement for use in connection with drinking and/or eating is indicated generally in FIG. 4 by reference number 300. The implement 300 includes a tube 328 having a passage 334 therethrough. The tube 328 is fabricated, for example, of plastic and the implement 300 can be used, for example, as a drinking straw and/or stirrer. At least a portion of the tube 328 is transparent and/or translucent.

An optional top 336 is affixed on an upper end 338 of the tube 328. The top 336 includes a plug 340 that fits inside the upper end 338 and a cap 342 that fits over the upper end 338. In other configurations, either the plug 340 or the cap 342 (or other means of attaching the top 336 to the tube end 338) could be used. The top 336 may be permanently attached to the tube 328 or may be removable to allow the implement 300 to be used also as a straw. The top 336 may include an ornament 344 including, for example, text and/or other indicia. The top 336 may be partly or completely transparent, opaque and/or translucent.

A housing 346 for a power source 348 is situated in the passage 334 such that (absent the top 336) a fluid may be drawn through the passage 334 past the housing 346. For example, the housing 346 may be attached by one or more spokes 352 to a lower end 356 of the tube. Thus, for example, a beverage being sucked by a user through the implement 300 flows around the spoke(s) 352 into the tube 328. In another configuration, the housing 346 may be situated asymmetrically in the passage 334, for example, attached directly to the tube 328, thereby obviating any need for spoke(s). The housing 346 may be fabricated of plastic and may be at least partly transparent and/or translucent. The housing includes an elongate extension 360, for example, a clear plastic membrane, extending into the passage 334.

The implement 300 also includes one or more light sources 364 in the tube 328 powered by the power source 348. The light source(s) 364 may include, for example, an electroluminescent wire powered by the power source 348 via a transformer 370. The electroluminescent wire 364 extends, via the housing extension 360, into the passage 334. In other configurations, other or additional types of light sources could be included in the extension 360. For example, one or more LEDs could be spaced within the extension 360 and electrically connected with the power source 348. The light source(s) 364 and/or extension 360 could also be positioned in the top 336 and/or ornament 344, preferably in a configuration wherein the top 336 is permanently affixed to the tube 328. The power source 348 is operable using a switch 382 and may include an optional control chip as previously described with reference to FIG. 1.

To use the implement 300, a user may activate the switch 382 to switch on the power source 348 and light source 364. When the light source 364 is activated, light may pass through the housing extension 360, tube 328 and optional top 336. Where the housing extension, tube and/or top are translucent, the light may cause the housing extension, tube and/or top to glow. In a configuration that includes a liquid-activatable switch 382, when the user proceeds, for example, to use the implement 300 to stir a beverage, the light source(s) 364 are switched on. It can be appreciated that a variety of lighting effects can be produced in the implement 300 and/or in a liquid or other substance surrounding at least part of the implement 300, depending on the transparency and/or translucence of various portions of the tube 328, top 336 and/or housing extension 360.

Figure 5:
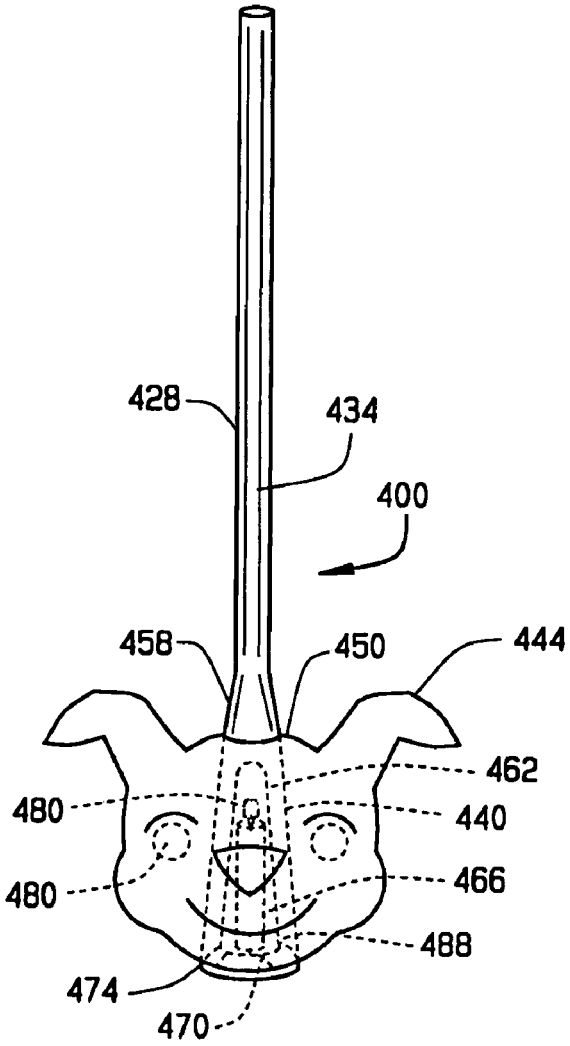
FIG. 5 is a perspective view of an implement for use in connection with drinking and/or eating in accordance with another exemplary embodiment.

Another configuration of an implement for use in connection with drinking and/or eating is indicated generally in FIG. 5 by reference number 400. The implement 400 includes a tube 428 having a passage 434 therethrough. The tube 428 is fabricated, for example, of plastic and the implement 400 can be used, for example, as a drinking straw, stirrer, and/or support for cotton candy, a frozen consumable, or other consumable. At least a portion of the tube 428 is transparent and/or translucent.

As shown in FIG. 5, a lower portion 440 (shown in phantom) of the tube 428 is flared in shape and includes a display element 444. The display element 444 could be theme-related or advertisement-related and may be fabricated separately from the tube 428. The display element 444 may be made of plastic and/or other non-toxic material(s). To affix the display element 444 to the tube 428, the tube 428 may be inserted through a bore 450 of the display element. In other configurations, a display element could be attached to an outer surface 458 of the tube 428, for example, by bonding the element to the lower portion 440 (and/or to any other portion) of the tube 428. Embodiments also are contemplated in which all or part of the display element 444 is fabricated as part of the tube 428. A display element could be formed, for example, by shaping one or more chambers and optionally filling the chamber(s) with a substance as previously described with reference to FIGS. 2A and 2B.

A housing 462 for a power source 466 is situated in the passage 434 such that a fluid may be drawn through the passage 434 past the housing 462. For example, the housing 462 may be attached by one or more spokes 470 to a lower end 474 of the tube. Thus, for example, a beverage being sucked by a user through the implement 400 flows around the spoke(s) 470 into the tube 428. In another configuration, the housing 462 may be situated asymmetrically in the passage 434, for example, attached directly to the tube 428, thereby obviating any need for spoke(s). The housing 462 may be fabricated of plastic and may be at least partly transparent and/or translucent.

The implement 400 also includes one or more light sources 480 in the tube 428 and/or the display element 444 powered by the power source 466. The light source(s) 480 may include, for example, one or more LEDs, optical fibers, electroluminescent wires, electroluminescent sheeting, combinations thereof, etc. As shown in FIG. 5, three LEDs 480 are electrically connected with the power source 466 (e.g., a battery or battery pack inside the housing 462, etc.). An electrical connection between the power source 466 and a light source 480 in or on the display element 444 may be established, for example, via a spoke 470 and/or the tube lower end 474. The power source 466 is operable using a switch 488 and may include an optional control chip as previously described with reference to FIG. 1.

To use the implement 400, a user may activate the switch 488 to switch on the power source 466 and light sources 480. When the light sources 480 are activated, light may pass through the housing 462, tube 428 and/or display element 444. It can be appreciated that a variety of lighting effects can be produced in the implement 400 and/or in a liquid or other substance surrounding at least part of the implement 400, depending on the transparency and/or translucence of various portions of the tube 428, housing 462 and/or display element 444.

Figure 6:
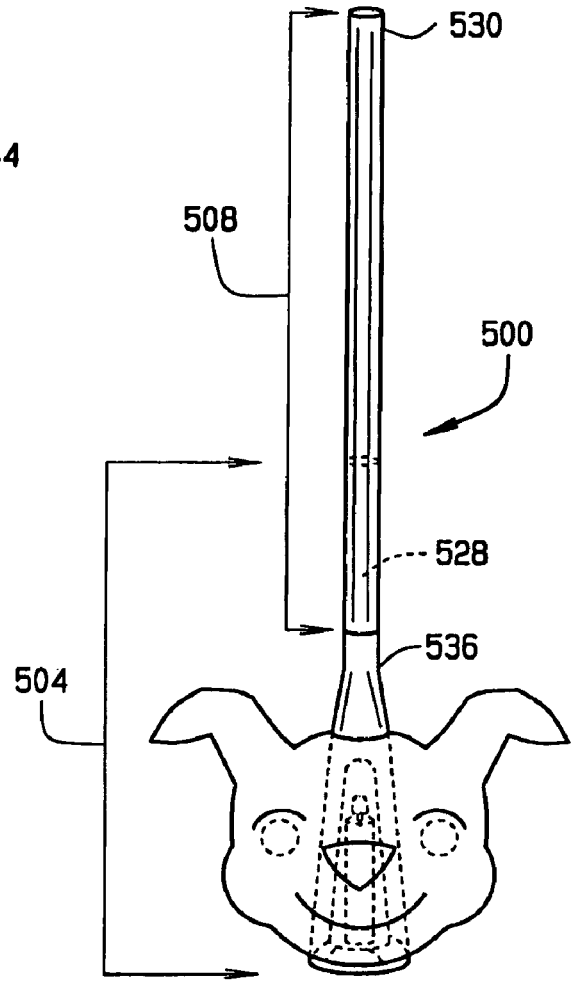
FIG. 6 is a perspective view of a combination of a drinking straw and an implement for use in connection with drinking and/or eating in accordance with another exemplary embodiment.

A combination in accordance with another configuration of the present invention is indicated generally in FIG. 6 by reference number 500. Generally, an implement may be configured as described herein and can be used in combination with a conventional drinking straw. For example, an implement 504 similar to the implement 400 is included in the combination 500. A straw 508 is placed over a tube 528 of the implement 504 and may be pushed against a flared portion 536 of the tube 528 to provide a snug fit between the straw 508 and the implement 504. In another configuration, the straw 508 could be inserted into the tube 528. Additionally or alternatively, the straw 508 may be bonded to the implement 504. Thus, the implement 504 may be operatively connected with the straw 508 such that, when a user sucks an upper end 530 of the straw, liquid may be drawn through the combination 500. In some configurations, the implement 504 can be cleaned and/or reused with different straws.

Figure 7:
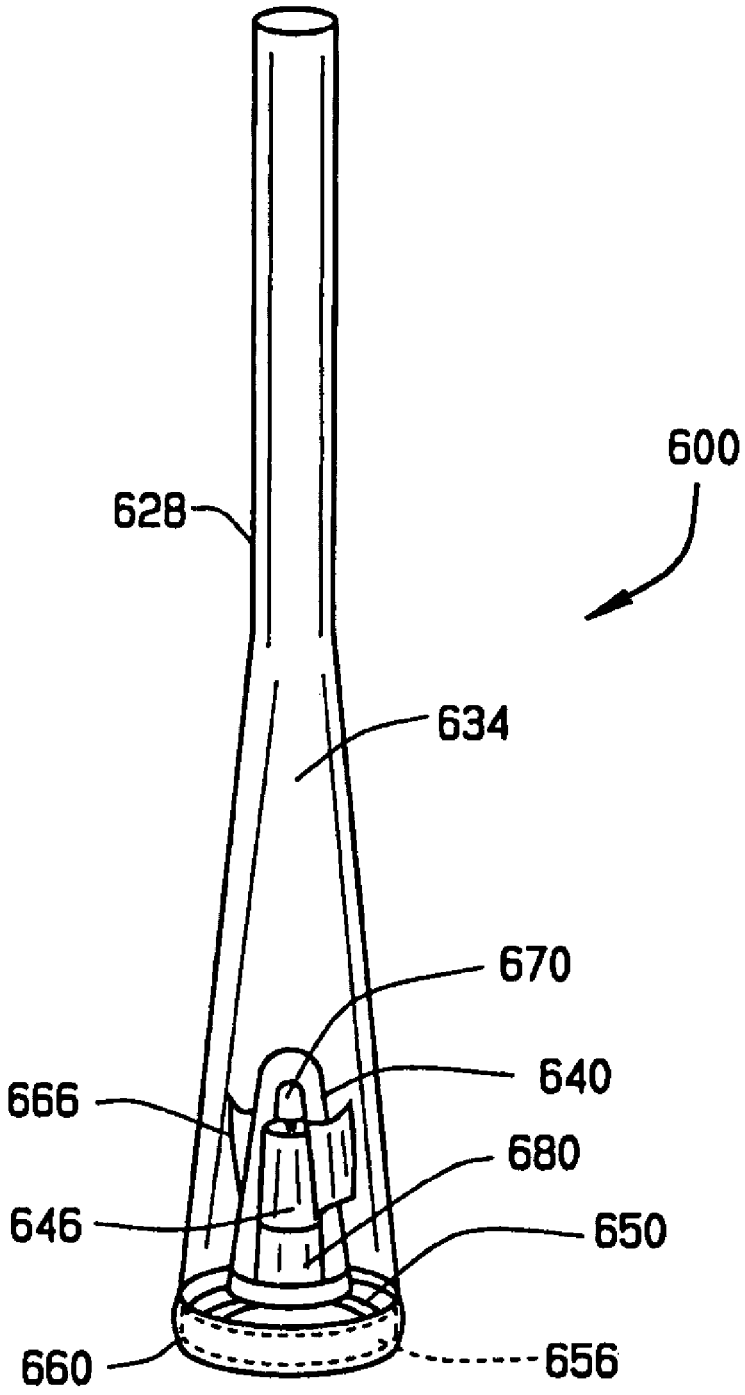
FIG. 7 is a perspective view of an implement for use in connection with drinking and/or eating in accordance with another exemplary embodiment.

Another configuration of an implement is indicated generally in FIG. 7 by reference number 600. The implement 600 includes a tube 628 having a passage 634 therethrough. The tube 628 is fabricated, for example, of plastic. The implement 600 can be used, for example, as a drinking straw and/or stirrer. At least a portion of the tube 628 is transparent and/or translucent.

A housing 640 for a power source 646 is situated in the passage 634 such that a fluid may be drawn through the passage 634 past the housing 640. The housing 640 is attached by one or more spokes 650 to a rim 656 (shown in phantom) that may be rotated within a lower end 660 of the tube. The housing 640 may include blades 666 or may otherwise be configured to rotate with the rim 656 within the passage 634, for example, when a beverage being sucked by a user through the implement 600 flows around the spoke(s) 650 past the housing 640. The housing 640 may be fabricated of plastic and may be at least partly transparent and/or translucent.

The implement 600 includes one or more light sources 670 in the tube 628 powered by the power source 646. The light source(s) 670 may include, for example, one or more LEDs, optical fibers, and/or electroluminescent wires. As shown in FIG. 7, the light source 670 includes a LED electrically connected with the power source 646 (e.g., a battery or battery pack inside the housing 640, etc.). The power source 646 is operable using a switch 680 and may include an optional control chip as previously described with reference to FIG. 1.

To use the implement 600, a user may activate the switch 680 to switch on the power source 646 and light source 670. When the light source 670 is activated, light may pass through the housing 640 and tube 628. Where the housing and/or tube are translucent, the light may cause the housing and/or tube to glow. It can be appreciated that a variety of lighting effects can be produced in the implement 600 and/or in a liquid or other substance surrounding at least part of the implement 600, depending on the transparency and/or translucence of various portions of the tube 628 and/or housing 640.

Figure 8:
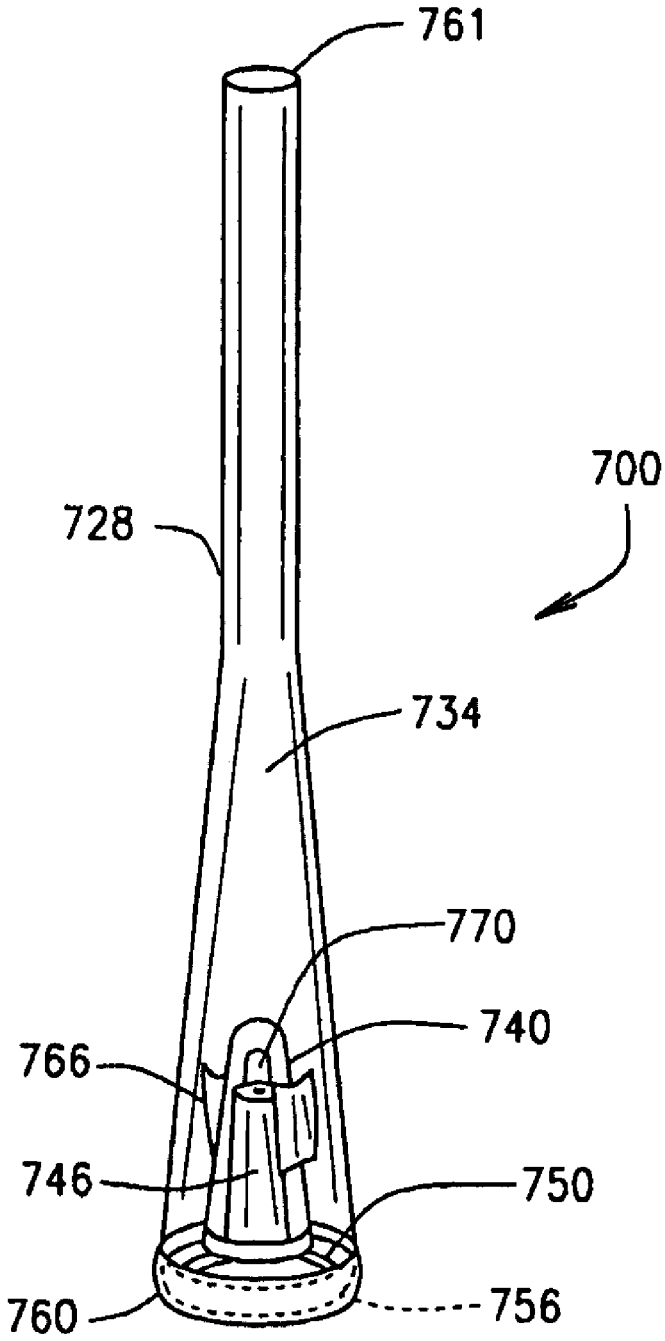
FIG. 8 is a perspective view of an implement for use in connection with drinking and/or eating in accordance with another exemplary embodiment.

FIG. 8 illustrates an exemplary implement 700 embodying one or more aspects of the present disclosure. As shown, the implement 700 includes a tube 728 having an inner fluid flow channel or passage 734 therethrough. The tube 728 can be fabricated from plastic or other suitable materials. The implement 700 can be used, for example, as a drinking straw and/or stirrer. At least a portion of the tube 728 can be transparent and/or translucent.

A housing 740 is situated at least partially within the passage 734 such that fluid may be drawn through the passage 734 generally past at least a portion of the housing 740. In this particular embodiment, the housing 740 is attached by spokes 750 to a rim 756 (shown in phantom). The rim 756 may be rotated within a lower end 760 of the tube 728. The housing 740 may include blades 766 (or other suitable means) for causing rotation of the housing 740 and the rim 756 within the passage 734. For example, the housing 740 may be caused to rotate when a beverage being sucked by a user through the implement 700 flows around the spoke(s) 750 past the housing 740 and contacts the blades 766.

In this particular embodiment, rotation of the housing 740 can also generate an electrical current (e.g., alternating current, direct current, combinations thereof, etc.) for electrically powering one or more light sources 770. For example, the implement 700 can include at least one electrical generator for generating electrical power for operating the one or more light sources 700. The electrical generator can include a stator within the housing 740, and a rotor within the stator 746. The rotor can be coupled to the housing 740 for common rotation therewith. Accordingly, rotation of the housing 740 causes the rotor to rotate relative to the stator 746, which, turn, produces electrical current for powering the light sources 770. Alternatively, the rotating housing 740 may drive a relatively small armature, which then produces an electrical current for powering the light sources 770 to illuminate.

The light source(s) 770 may include, for example, one or more LEDs, optical fibers, electroluminescent wires, electroluminescent sheeting, combinations thereof, etc. In some preferred embodiments, the light sources 770 comprise LEDs, which generally require far less electrical power for operation than incandescent light sources.

To use the implement 700, a user may simply insert the lower end 760 of the implement 700, for example, into a beverage. The user may then begin sucking on the implement's other end 761 to thereby cause liquid to flow into the inner fluid flow channel 734 of the tube 728. The liquid may flow around the spoke(s) 750 and then contact the blades 766. The pressure upon the blades 766 created by contact with the liquid can cause the housing 740 to rotate. The rotating housing 740, in turn, may rotate a rotor relative to the stator 746 to thereby produce electrical current for powering the light sources 770.

Figure 9:
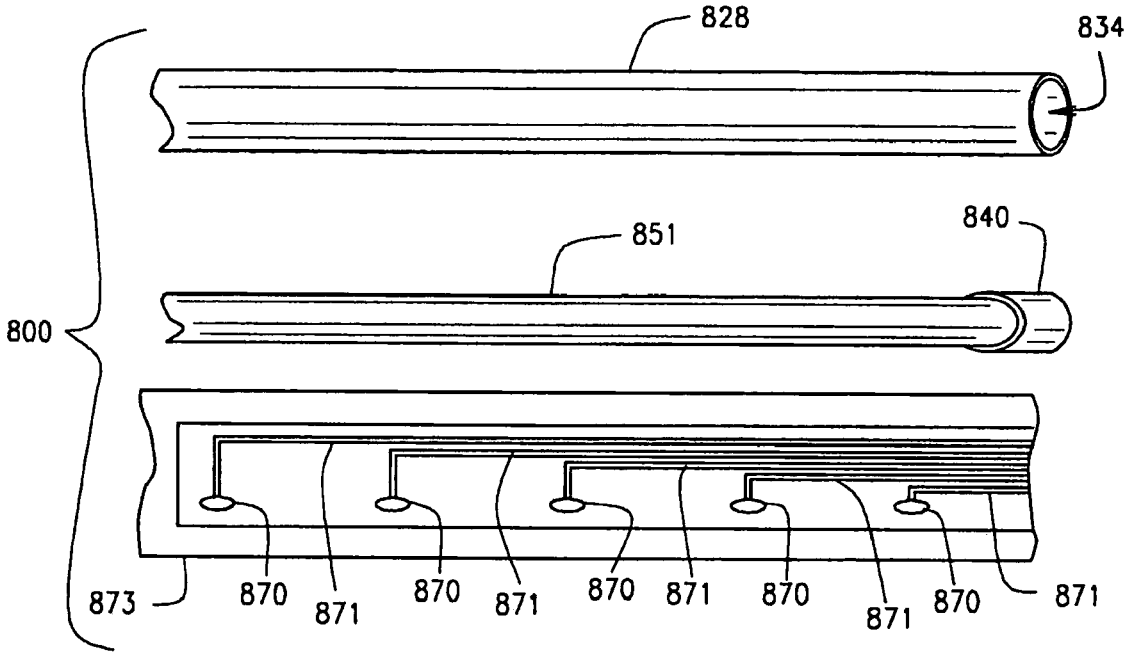
FIG. 9 is an exploded perspective view of an implement for use in connection with drinking and/or eating in accordance with another exemplary embodiment.
Figure 10:
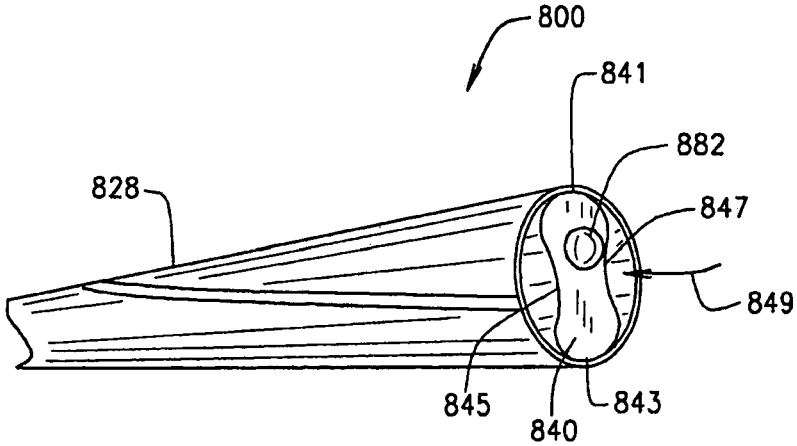
FIG. 10 is an end perspective view of the implement shown in FIG. 9 after the components of the implement have been assembled.

FIGS. 9 and 10 illustrate another embodiment of an implement 800 for use in connection with drinking and/or eating. As shown in FIG. 9, the implement.800 includes an outer tube

828 having an inner fluid flow passage 834 therethrough. In one particular embodiment, the outer tube 828 is configured such that the inner fluid flow passage 834 has a diameter of about one-half inch. The dimensions set forth in this paragraph (as are all dimensions set forth herein) are mere examples and can be varied depending, for example, on the particular application.

The implement 800 also includes a housing or cartridge 840. As shown in FIG. 10, the housing 840 can be positioned within the inner fluid flow passage 834. The housing's end portions 841 and 843 can be bonded or attached to the tube 828 in an exemplary manner that allows liquid flowing within the inner fluid flow passage 834 of the tube 828 to also flow generally around and past the housing's side portions 845 and 847 (as generally represented by arrows 849 in FIG. 10).

The implement 800 can also include one or more power sources and a switching mechanism 882. The switching mechanism 882 can be used for switchably connecting one or more light sources 870 (FIG. 9) to one or more power sources within the housing 840. A wide range of switching mechanisms can be used for switch 882, such as push button switch, a dome push switch, a membrane switch, etc.

With continued reference to FIG. 9, the implement 800 also includes an inner straw or tube 851 and at least one light source 870 positionable within the inner straw 851. In the particular embodiment illustrated in FIG. 9, LEDs 870 and conductive leads 871 are surface mounted on (e.g., electronically welded onto, etc.) a flexible lightweight ribbon cable 873, which, in turn, is positionable within the inner straw 851.

Figure 11:
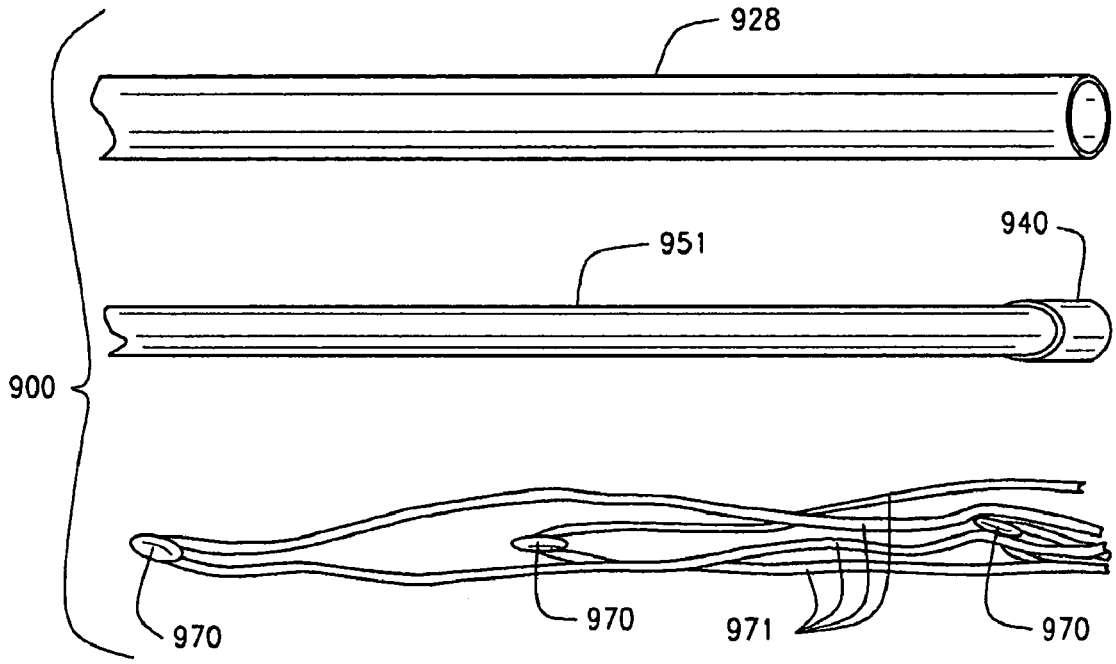
FIG. 11 is an exploded perspective view of an implement for use in connection with drinking and/or eating in accordance with another exemplary embodiment.

Alternatively, other light sources and conductive leads in any suitable number and/or other mounting methods are also possible. For example, FIG. 11 illustrates an alternative embodiment of an implement 900 having an outer tube 928, a housing 940, an inner tube 951, and LEDs 970. But in this particular embodiment, the implement 900 includes wiring 971 for connecting the LEDs 970 to one or more power sources within the housing 940.

With reference back to FIGS. 9 and 10, the ribbon cable 873 (along with the LEDs 870 and conductive leads 871 thereon) can be positioned within an inner cavity or passage of the inner straw 851. By way of example, the flexible ribbon cable 873 can be positioned within the inner straw 851 such that the LEDs 870 are spaced apart from one another generally along a length of the inner straw 851. In addition, the LEDs 870 can be electrically connected to one or more power sources (e.g., batteries, etc.) with the housing 840 via conductive leads 871.

After the ribbon cable 873 (along with the LEDs 870 and conductive leads 871 thereon) have been positioned within the inner straw 851, the inner straw 851 can be sealed. In some embodiments, the inner straw 851 may be hermetically sealed and/or sealed in a substantially water-tight fashion.

An exemplary assembly may include inserting the ribbon cable 873 through an open end of the inner straw 851. At least a portion of the housing 840 (and one or more components housed therein in some embodiments) may also be received within an open end of the inner straw 851. The inner straw 851 may be bonded or attached (e.g., adhesively bonded, chemically bonded, mechanically fastened, heat-sealed, hot-melted, etc.) to the housing 840, thereby sealing the open end of the inner straw 851. In some embodiments, both ends of the inner tube 851 may be open with each end then being sealed by any suitable means (e.g., adhesively bonded, chemically bonded, mechanically fastened, heat-sealed, hot-melted, etc.). In some embodiments, the housing 840 (along with the one or more power sources therein) can also be at least partially positioned within the inner straw 851.

The sealed unit (comprising the inner straw 851 bonded to the housing 840 (or portion thereof) and components therein LEDs 870, conductive leads 871, and ribbon cable 873) can then be inserted into the inner fluid flow passage 834 of the outer straw 828. End portions 841 and 843 of the housing 840 can be bonded or attached (e.g., adhesively bonded, glued, adhered, friction fitted, etc.) to the tube 828. Accordingly, liquid drawn up through the inner fluid flow channel 834 of the outer tube 828 can flow generally past the housing side portions 845 and 847. The liquid may then flow generally along the length of the outer surfaces of the sealed inner straw 851 and components therein. That is, the liquid may flow generally within the spaced distance separating the outer surface of the inner straw 851 and the inner surface of the outer tube 828.

Various embodiments shown and described herein include power sources, light sources, and/or switches generally positioned at a base or bottom portion of the implement. In other embodiments, any one or more of the components (e.g., power sources, light sources, switching mechanisms, etc.) of any one or more the implements disclosed herein (e.g., 20, 100, 200, 300, 400, 500, 600, 700, 800, 900, etc.) can be positioned at other suitable locations than what is shown in the figures. For example, other embodiments can include power sources, light sources, and/or switching mechanisms positioned at about an implement's top portion at which the user's mouth is placed instead of (or in addition) to the bottom portion of the implement. As further examples, other embodiments can include one or more power sources, light sources, and/or switching mechanisms positioned at about a location generally between the implement's top and bottom portions.

The embodiments illustrated in the figures generally show the fluid inlets/openings that allow fluid into the inner fluid flow passage about the bottom of the implement. Alternatively, other embodiments include one or more fluid inlets/openings at other suitable locations besides what is shown in the figures. For example, other embodiments can include fluid inlets/openings spaced above the bottom portion of the implement such that the fluid inlets/openings are disposed higher than one or more of the power sources, light sources, and/or switching mechanisms. As further examples, other embodiments can include fluid inlets/openings at more than one location, such as at the bottom and at one or more other locations spaced above the bottom. In yet other embodiments, an implement can include more than one inner fluid flow passage, such as two or more concentric fluid flow passages.

In addition, some embodiments of an implement include a tube having a circular cross-section. Other embodiments, however, can include a tube having a non-circular cross-sectional, such as rectangular, triangular, hexagonal, ovular, other polygonal shapes, etc.

Some embodiments can include a housing or cartridge in which is housed one or more batteries (or other power sources). In such embodiments, the cartridge can be removable from the implement, for example, to replace the batteries. Some embodiments can also include rechargeable batteries. Other embodiments can include other power sources including disposable batteries, solar cells, kinetic power sources, etc.

Various embodiments can also include at least one power source spaced apart or remote from an implement. In such embodiments, at least one remote power source (e.g., rechargeable battery pack, wall outlet, etc.) can provide the electrical power for operation of the lighted implement. The light source(s), in turn, may be electrically connected to the at least one remote power source by electrical wiring or cords (e.g., an insulated flexible electric wire fitted with a plug, etc.).

Some embodiments can include two or more batteries positioned side-by-side in an edge-to-edge orientation (as compared to being stacked or positioned on top of each other). For example, one exemplary embodiment can include two watch batteries positioned side-by-side in an edge-to-edge orientation. With this orientation, the watch batteries can be housed within a more low profile or thinner housing than embodiments in which the batteries are stacked on top of each another. Advantageously, thinner/more low profile housings can be positioned within straws or tubes having smaller diameters than those particular embodiments having larger housings for the batteries.

Various embodiments of the implements disclosed herein can be used in a variety of ways, including as straws and/or stirrers in connection with drinking hot and/or cold beverages, as sticks or holders for cotton candy, ice cream, frozen ice, candy, lollipops, or other consumables. Additionally, in some configurations, parts of the implements can be reused. For example, various embodiments include removable power sources, which can be replaced. Embodiments of implements disclosed herein can provide a wide variety of illumination effects, within the implements and/or also in a transparent or translucent food or drink surrounding at least part of the implement. Implements disclosed herein can provide aesthetic, interesting, and/or eye-catching medium for advertising, for example, through lighted display elements, top ornaments, and/or indicia.

Indicia, such as text or logos, can be provided (e.g., etched, carved, silk-screened, printed, integrally formed, etc.) on a portion of any one or more of the implements disclosed herein. In such embodiments, the indicia could be highlighted (e.g., illuminated, back-lighted, etc.) by light from one or more light sources of the implement. In some embodiments, a lighted implement includes a light-transmissive portion having one or more indicia (e.g., printed indicia, silk-screened indicia, pad printed indicia, indicia formed by optical fibers, integrally formed, etched, etc.). The one or more indicia can be highlighted (e.g., illuminated, back-lit, etc.) by light from the light source. By way of example, the one or more indicia may be integrally formed (e.g., etched, carved, etc.) at a sufficient depth into the light-transmissive portion for altering light emitted by the at least one light source. The one or more indicia may be integrally formed into the light-transmissive portion at an acute angle relative to a direction at which light emitted by the at least one light source is transmitted through the light-transmissive portion. In an exemplary embodiment, one or more indicia are etched or carved (e.g., with a cutting tool, knife, razor blade, laser, chemically etched, drilled, etc.) into the light-transmissive material (e.g., plastic, etc.) forming at least a portion of the lighted implement. This etching can increase the light transmissibility of the etched indicia and/or allow the indicia to alter (e.g., capture, refract, disperse, diffuse, diffract, etc.) light traveling within the light-transmissive material. Etching the indicia can affect the way that the light interacts with the etched indicia. For example, with relative deeply carved or etched indicia, the light can be captured in the edges of and thus highlight the indicia. Preferred angle(s) and/or depth at which the indicia can be formed into the light-transmissive material can depend on the particular application. In exemplary embodiments, the indicia can be formed (e.g., etched, carved, etc.) into the light-transmissive material at an acute angle of about +/−forty-five degrees relative to the direction of travel of the light. The indicia can be etched into an outer or external surface of the light-transmissive material. Additionally, or alternatively, the indicia can be etched into an internal surface of the light-transmissive material.

In any of the various embodiments disclosed herein, an implement can include a plurality of light-altering particles (e.g., glitter, reflective particles, refractive particles, translucent particles, glass-like prisms, colored particles, clear particles, etc.) within a tube (e.g., suspended within hot/cold gel or other suitable substance within the tube sidewall, etc.). These particles can receive and alter the light from a light source to create yet an additional feature. In addition to, or as an alternative to having light-altering particles within a sidewall or other portion of a tube, some embodiments also include a tube having an inner and/or outer surface that is configured for altering the light. For example, the tube can include inner and/or outer faceted surface portions. As other examples, crushed crystal or crystal-like materials may be disposed along an inner surface portion of the tube. Further examples can include a tube having an inner surface portion configured with pyramidal or triangular facets such that this inner faceted surface portion is operable as a lens for altering the light (e.g., magnifying, improving disbursement of, etc.) the light. Such facets can take on a wide variety of configurations (e.g., shapes, sizes, relative positioning, etc.), and each facet does not necessarily have the same configuration as the other facets. In these various embodiments that include some means for altering the light, the implement can produce a visibly pleasing or sparkling light effect. This light display can be particularly pleasing in embodiments in which the tube is made of a substantially transparent material that tends to disappear or not be readily visible, thereby giving the impression of small points of light within the beverage receptacle.

In any of the various embodiments disclosed herein, the operation of the light sources may be controlled by a controller in accordance with user input to provide such features as blinking, strobing, and/or color changes. The controller can include an integrated circuit/printed circuit assembly (e.g., integrated circuits in a printed circuit assembly) and at least one switch. The switch may, for example, allow the user to select from among various display modes for the light sources, such as an off-light mode, an on-light mode, a mode in which each of the light sources simultaneously emit steady or non-flashing light, a mode in which the light sources emit light intermittently, a mode in which the various light sources illuminate or blink at different times in accordance with a predetermined sequence or order, a mode in which the light sources emit light that phases between or blends colors, a mode in which the light sources emit light randomly, a mode in which the light sources pulsate to sounds (e.g., music at a nightclub, etc.), and/or a mode combining one or more of the foregoing. Such sounds may be produced by the lighted implement itself (e.g., via a speaker built-in to the lighted item) or a source external to the lighted item (e.g., ambient sounds, etc.). In some embodiments, sounds can cause synchronized pulsation of the light sources of two or more different lighted implements, thus providing a pleasing light pattern or effect. The switch can include any one of a wide range of switches, a push-button switch, a dome push switch, a membrane switch, motion-responsive switches, light-sensitive switches, temperature-sensitive switches, compression switches, voice activated switches, moisture-sensitive switches, etc.

A wide range of materials can be used for a tube of an implement, such as biologically safe materials having properties suitable for placing it in contact with a material that is to be ingested and falls under the Food and Drug Administration food-contact grade properties. Exemplary materials include polyvinyl chloride (PVC), polymers, plastics, flexible materials, rigid materials, materials capable of being mass produced with relatively low manufacturing costs, among other materials suited for the intended purpose.

The various lighted implements disclosed herein can be configured to produce any of a wide range of colored light depending at least in part on user preferences. User preferences may in turn be based on any number of factors including the color of the clothes the user is wearing and/or the type of event (e.g., dance, sporting event, etc.) the user will attend while using the lighted implement. For example, the user may prefer a lighted implement that produces colored light consistent with the home team's colors when attending a sporting event, such as a football game.

In any one or more of the various embodiments disclosed herein, an implement may include at least a portion (e.g., indicia, sidewall of a tube, indicia, etc.) that is ultraviolet-reactive and at least one light source that produces ultraviolet light for illuminating the ultraviolet-reactive portion. For example, a tube (or at least a portion thereof) can be formed from a material responsive to the ultraviolet A (UVA) radiation component of black light produced by the light source, which, in turn, produces a visually stimulating effect. Additionally, or alternatively, an implement can also include an ultraviolet-reactive material within a tube. In which case, the ultraviolet-reactive material can be responsive to the ultraviolet A (UVA) radiation component of black light produced by the light source, which, in turn, produces a visually stimulating effect. Exemplary ultraviolet-reactive materials that can be used for a tube, a tube portion, and/or a filler within a tube include plastic materials containing phosphor (e.g., Zinc Sulfide, Strontium Aluminate, etc.), fluorescent materials, etc.

In any one or more of the various embodiments disclosed herein, an implement may include a vibrator for causing at least a portion of the implement to vibrate. In such embodiments, the vibrator may be configured for imparting sufficient vibration to the implement for also imparting at least some vibration to the liquid within the beverage receptacle in which the implement is placed. Vibrations imparted to the liquid may, for example, help in mixing a beverage and/or helping to cause ice within the beverage receptacle to more quickly cool a beverage. By way of example only, the vibrator may comprise a relatively small motor off-access or a piezoelectric buzzer. Other examples of vibrators include an electromagnetic motor, rotor shaft, and eccentric rotor.

In some embodiments, a lighted implement can include a controller and a push-button switch for switchably connecting at least one light source to at least one power source. The switch may be positioned within the outer tube and bee coupled to an externally flexible surface portion of the outer tube such that application of external pressure upon the externally flexible surface portion activates the switch, thereby causing operation of the at least one light source. The external pressure may, for example, be applied by the user squeezing the outer tube at the externally flexible surface portion. The switch may also allow the user to cycle through the various display modes or select a particular color for the at least one light sources by successively squeezing the outer tube at about the externally flexible surface portion. Additionally, the switch may also allow the user to dim or brighten the intensity of the light, for example, by holding down the switch with continuously applied pressure to the outer tube at about the externally flexible surface portion.

In some embodiments, a lighted implement can include one or more electroluminescent light sources (e.g., one or more electroluminescent wires, electroluminescent sheeting, combinations thereof, etc.) that extend from at least one power source to form at least one display member for the implement. The display member can be enclosed, for example, in a clear casing formed by turning over and sealing a seam of the implement at which portions of the implement are joined together. When the power source is activated, the electroluminescent light source provides light. Alternatively, other embodiments can include additional or alternative light sources (e.g., LEDs, chemiluminescent light sources, black light sources, etc.) disposed within a casing at least partially formed by a seam. Further embodiments can also include a casing at least partially formed by a seam internal to or within the implement. By way of example, various embodiments include an internal or external pocket or pouch at least partially formed by a corresponding internal or external seam, where at least one light source (e.g., glow stick, LED array, electroluminescent light source, LED, chemiluminescent light source, etc.) is disposed within the pouch or pocket. In some embodiments, an implement includes a display member in the form of a sticker that is transparent and/or translucent at least in part, such that an electroluminescent light source (e.g., electroluminescent wire, etc.) beneath the sticker can be visible. The sticker can be applied over the electroluminescent light source and onto the implement.

In other embodiments, a lighted implement includes a sealed unit (e.g., housing, cartridge, pod, etc.) having one or more light sources, one or more power sources for electrically powering the one or more light sources, and a switching device for switchably connecting the light source(s) to the power source(s). The sealed unit is preferably hermetically sealed and/or sealed in a substantially water-tight fashion such that liquid is unable to enter the sealed unit, thereby protecting the electronic components housed within the sealed unit. The sealed unit can be slidably retained within a fluid flow channel or passage of a straw or tube. Accordingly, some embodiments have the sealed unit configured (e.g., with blades, fins, contact surface, lower or bottom portion, etc.) such that the sealed unit is caused to slide upwardly towards the user's mouth as liquid being drawn up through the fluid flow channel of the straw as the user sucks on the straw. But when the liquid stops moving upwardly through the straw (e.g., when the user stops sucking on the straw, etc.), gravity can then cause the sealed unit to slidably move downwardly in the straw's fluid flow channel back to the initial or resting position of the sealed unit.

In some preferred embodiments, a liquid-activatable switch is provided such that the switch is activated when the switch comes into contact with liquid. For example, the switch may include electrical terminals or probes external to the sealed unit, such that the electrical terminals are electrically connected to each other by an electrically conductive liquid drawn into the straw's fluid flow channel (e.g., when the user begins sucking on the straw and/or when the user inserts the lower end of the straw into a liquid causing at least some liquid to enter the fluid flow channel, etc.), thereby switchably connecting the light source(s) to the power source(s). The switch may be subsequently deactivated when there is no longer any liquid electrically connecting the terminals to each other, such as when the straw is removed from the liquid. Other example embodiments include a temperature sensitive switch that automatically activates when the user inserts the lower end of the straw into a liquid (e.g., cool or hot beverage) having a temperature that causes the temperature sensitive switch to automatically activate. The switch may then be subsequently deactivated when the implement is removed from the cool beverage, and the switch returns to ambient temperature. Alternative exemplary switches include push-button switches, motion-responsive switches (e.g., ball-switches, translating-type reciprocating switches), temperature sensitive switches, magnetic switches, mechanical switches, electrical switches, manually-operated switches, automatically-operated switches, combinations thereof, etc.

In one particular embodiment, upper and lower end portions of a straw or tube can be pinched, crimped, or otherwise configured (e.g., having integrally formed narrower necked portions, separate component, etc.) to slidably retain a sealed unit within the straw's fluid flow channel, thereby inhibiting removal of the sealed unit from the straw's fluid flow channel. By way of example only, some embodiments include a straw or tube having a fluid flow passage with a diameter of about one-half inch. The straw includes pinched portions at about one inch from the top and bottom of the straw. A sealed unit is slidably retained within the fluid flow passage generally between the pinched portions. In some preferred embodiments, the sealed unit includes at least one LED, a liquid-activatable switch (e.g., exposed electrical terminals or probes, etc.), and at least one battery (e.g., a watch battery having a diameter of about one-fourth inch, etc.). The dimensions set forth in this paragraph (as are all dimensions set forth herein) are mere examples and can be varied depending, for example, on the particular application.

In other embodiments, one or more electroluminescent light sources (e.g., electroluminescent wire, electroluminescent sheeting material, combinations thereof, etc.) include sticky or adhesive backing such that the electroluminescent light source(s) can be applied directly onto the implement. The electroluminescent light source(s) can be connected to at least one power supply, such as a button battery and/or other power supply.

In some embodiments, an implement includes one or more electroluminescent light sources (e.g., one or more electroluminescent wires, electroluminescent sheeting materials, combination thereof, etc.) positioned generally between an inner layer and an outer layer of the implement. Additional embodiments include one or more electroluminescent sheeting materials disposed within and applied to one or more inner surface portions of an implement. Further embodiments include one or more electroluminescent sheeting materials applied to one or more outer surface portions of an implement.

Still further embodiments include one or more electroluminescent light sources that are integrally formed (e.g., printed, etc.) as part of the material forming an implement. In which case, the implement itself may be said to integrally include the light source.

Various embodiments can also include fillers capable of imparting heating, cooling, glow-like illumination, and/or luminescence to the adjacent environment. A wide range of fillers can be used in any one or more of the embodiments disclosed herein. Examples of fillers are now provided for purposes of illustration only, and not for purposes of limitations. In this regard, some embodiments can include one or more of the following fillers: polystyrene blend, acrylic, plastic beads or pellets, blue-ice refrigerant, fillers having a specific heat capacity which is higher than the specific heat capacity of air, fillers having a specific heat capacity which is comparable, higher, or lower than the specific heat capacity of water, fillers having heat-retaining and/or cold-retaining properties greater than air alone, fillers including eutectic salts, candle wax, polyethylene, polypropylene, phase change materials, filler having a specific heat capacity within a range of about 2300 joules per kilogram per degree Celsius to about 2500 joules per kilogram per degree Celsius, gels, water, and/or materials generally used in re-usable ice-packs, re-usable heating pads, hot/cold gel packs, single-use hand and toe warmers.

Other aspects provide methods relating to the use of lighted implements. In one exemplary embodiment, a method generally includes transmitting a signal to at least one lighted implement from a source external to the lighted implement, receiving the signal (e.g., wirelessly, etc.) at the lighted implement, and controlling the operation of at least one light source of the lighted implement in accordance with the signal. In some embodiments, a method can also include transmitting the signal to a plurality of lighted implements each of which includes at least one light source; and controlling operation of the light sources in accordance with the signal (e.g., synchronizing the operation of the light sources in accordance with the signal, etc.).

The operation of the light sources of the lighted implements can be synchronized in accordance with the signal to provide a stimulating and pleasing visual light display or effect. For example, fans at a sporting event can use lighted implements that include light sources which, in response to a signal, emit synchronized flashing light in colors consistent with the home team's colors. Or for example, the signal may cause the light sources to produce a lighted wave-like effect through the stadium stands.

Accordingly, various embodiments can provide a relatively easy and inexpensive way to enhance a mood or atmosphere of an occasion, to provide visual pleasure or serenity (e.g., enhance one's enjoyment while consuming a beverage or food item), to convey messages to users (e.g., by way of indicia), among other numerous novelty-related results.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order or performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An implement for use in connection with drinking and/or eating, the implement comprising:

a first tube having at least one inner fluid flow passage therethrough in which fluid may be received and delivered through the at least one inner fluid flow passage;

a second tube having at least one inner cavity therein, at least a portion of the second tube being situated in the at least one inner fluid flow passage such that fluid may be received in and drawn through the at least one inner fluid flow passage generally past the at least a portion of the second tube in the at least one inner fluid flow passage;

at least one light source at least partially positioned within the at least one inner cavity of the second tube; and at least one housing configured to receive at least one power source therein for electrically powering the at least one light source, at least a portion of the at least one housing being situated in the at least one inner fluid flow passage such that fluid may be received in and drawn through the at least one inner fluid flow passage generally past the at least a portion of the at least one housing in the at least one inner fluid flow passage.

2. The implement of claim 1, wherein at least a portion of the at least one housing is attached to the first tube.

3. The implement of claim 2, wherein the at least one housing includes generally opposing end portions and generally opposing side portions, and wherein the housing's end portions are attached to the first tube with the housing's side portions a spaced distance away from the first tube such that fluid may be received in and drawn through the spaced distance separating the housing's side portions from the first tube.

4. The implement of claim 3, wherein at least a portion of the at least one housing is attached to an open end of the second tube such that the interface between the at least one housing and the open end of the second tube is substantially sealed.

5. The implement of claim 1, wherein the at least one housing is situated entirely in the at least one inner fluid flow passage of the first tube.

6. The implement of claim 1, wherein the second tube is situated entirely in the at least one inner fluid flow passage of the first tube.

7. The implement of claim 1, wherein the at least one light source is situated entirely within the at least one inner cavity of the second tube.

8. The implement of claim 1, further comprising at least one electrically-conductive lead extending from the at least one light source through at least a portion of the at least one inner cavity of the second tube to the at least one housing for electrically connecting the at least one light source to the at least one power source within the at least one housing.

9. The implement of claim 8, further comprising at least one substrate to which the at least one electrically-conductive lead is coupled, and wherein at least a portion of the substrate is situated within the at least one inner cavity of the second tube.

10. The implement of claim 8, further comprising at least one ribbon cable having at least a portion situated within the at least one inner cavity of the second tube, wherein the at least one light source comprises at least one LED mounted to the at least one ribbon cable, and wherein at least a portion of the electrically-conductive lead is mounted to the at least one ribbon cable.

11. The implement of claim 1, wherein the implement is operatively connected with a drinking straw.

12. An implement for use in connection with drinking and/or eating, the implement comprising:

a first tube having at least one inner fluid flow passage therethrough in which fluid may be received and delivered through the at least one inner fluid flow passage;

a second tube having at least one inner cavity therein, the second tube situated in the at least one inner fluid flow passage such that fluid may be received in and drawn through the at least one inner fluid flow passage generally past the second tube in the at least one inner fluid flow passage;

at least one light source within the at least one inner cavity of the second tube;

at least one housing configured to receive at least one power source therein for electrically powering the at least one light source, the at least one housing coupled to the second tube with the interface between the at least one housing and the second tube being substantially sealed, the at least one housing situated in the at least one inner fluid flow passage such that fluid may be received in and drawn through the at least one inner fluid flow passage generally past the at least one housing in the at least one inner fluid flow passage; and at least one electrically-conductive lead extending from the at least one light source through at least a portion of the at least one inner cavity of the second tube to the at least one housing for electrically connecting the at least one light source to the at least one power source within the at least one housing.

13. The implement of claim 12, wherein the at least one housing includes generally opposing end portions and generally opposing side portions, and wherein the housing's end portions are attached to the first tube with the housing's side portions a spaced distance away from the first tube such that fluid may be received in and drawn through the spaced distance separating the housing's side portions and the first tube.

14. The implement of claim 12, further comprising at least one substrate situated within the at least one inner cavity of the second tube, and wherein the at least one light source and the at least one electrically-conductive lead are coupled to the at least one substrate.

15. The implement of claim 12, further comprising at least one ribbon cable situated within the at least one inner cavity of the second tube, wherein the at least one light source comprises at least one LED coupled to the at least one ribbon cable, and wherein the electrically-conductive lead is coupled to the at least one ribbon cable.

16. The implement of claim 12, wherein the implement is operatively connected with a drinking straw.

17. An implement for use in connection with drinking and/or eating, the implement comprising:

at least one tube having at least one inner fluid flow passage therethrough in which fluid may be received and delivered through the at least one inner fluid flow passage;

at least one light source;

at least one housing rotatably mounted to the tube for rotation in the at least one inner fluid flow passage, the at least one housing including at least one blade extending into the at least one inner fluid flow passage and configured such that at least a portion of fluid received in and drawn through the at least one inner fluid flow passage contacts the at least one blade for causing rotation of the at least one housing; and at least one electrical generator for generating electrical power for operating the at least one light source, the at least one electrical generator including at least one stator within the at least one housing, and at least one rotor within the at least one stator, the at least one rotor being coupled to the at least one housing for common rotation therewith;

wherein the at least one light source comprises one or more light sources within and rotatable along with the at least one housing.

18. The implement of claim 17, further comprising at least one rim rotatably mounted to the at least one tube, and at least one spoke attaching the at least one housing to the at least one rim for common rotation therewith.

19. An implement for use in connection with drinking and/or eating, the implement comprising:

at least one tube having at least one inner fluid flow passage therethrough in which fluid may be received and delivered through the at least one inner fluid flow passage;

at least one light source;

at least one housing rotatably mounted to the tube for rotation in the at least one inner fluid flow passage, the at least one housing including at least one blade extending into the at least one inner fluid flow passage and configured such that at least a portion of fluid received in and drawn through the at least one inner fluid flow passage contacts the at least one blade for causing rotation of the at least one housing; and at least one electrical generator for generating electrical power for operating the at least one light source, the at least one electrical generator including at least one stator within the at least one housing, and at least one rotor within the at least one stator, the at least one rotor being coupled to the at least one housing for common rotation therewith;

wherein the at least one light source comprise one or more light sources within the at least one inner fluid flow passage such that fluid may be received in and drawn through the at least one inner fluid flow passage past the one or more light sources within the at least one inner fluid flow passage.

20. An implement for use in connection with drinking and/or eating, the implement comprising:

at least one tube having at least one inner fluid flow passage therethrough in which fluid may be received and delivered through the at least one inner fluid flow passage;

at least one power source situated entirely in the at least one inner fluid flow passage such that fluid may be received in and drawn through the at least one inner fluid flow passage generally around and past the at least one power source; and at least one light source at least partially within the at least one tube and electrically-powered by the at least one power source.

21. The implement of claim 20, further comprising at least one housing for the at least one power source positioned within the at least one inner fluid flow passage.

22. The implement of claim 21, wherein the at least one light source is within the at least one housing such that fluid may be received in and drawn through the at least one inner fluid flow passage past the at least one light source within the at least one housing.

23. The implement of claim 21, wherein the at least one tube includes a surface defining the at least one inner fluid flow passage, and wherein the implement further includes one or more spokes attaching the at least one housing to the tube surface defining the at least one inner fluid flow passage such that the at least one housing is spaced apart from the tube surface defining the at least one inner fluid flow passage.

24. The implement of claim 23, wherein the one or more spokes are configured such that the at least one housing is generally centrally positioned within the at least one inner fluid flow passage along a longitudinal centerline axis of the at least one inner fluid flow passage.

25. The implement of claim 21, wherein the at least one tube includes a surface defining the at least one inner fluid flow passage, and wherein the at least one housing is attached directly to the tube surface defining the at least one inner fluid flow passage such that the at least one housing is situated asymmetrically within the at least one inner fluid flow passage.

26. The implement of claim 20, wherein the at least one tube further comprises at least one sidewall, and wherein the at least one light comprises one or more light sources in the sidewall.

27. The implement of claim 20, wherein the at least one tube further comprises inner and outer surfaces defining one or more chambers in a sidewall of the at least one tube.

28. The implement of claim 27, further comprising a substance in at least one of the one or more chambers, wherein the substance includes at least one or more of a gel, a light-altering material, a hot/cold gel, a colored substance, a fluorescent substance, and a glow-in-the-dark substance.

29. The implement of claim 27, wherein the at least one light source comprise at least one LED and at least one optical fiber extending into at least one of the one or more chambers such that light from the at least one LED is transmitted through the at least one optical fiber.

30. The implement of claim 20, further comprising at least one housing rotatably mounted to the at least one tube for rotation in the at least one inner fluid flow passage.

31. The implement of claim 30, wherein the at least one housing further comprises at least one blade extending into the at least one inner fluid flow passage and configured such that at least a portion of fluid received in and drawn through the at least one inner fluid flow passage contacts the at least one blade for causing rotation of the at least one housing.

32. The implement of claim 30, wherein the at least one light source is within and rotatable along with the at least one housing.

33. The implement of claim 30, wherein the at least one power source is within and rotatable along with the at least one housing.

34. The implement of claim 20, wherein the at least one light source comprise one or more light sources within the at least one inner fluid flow passage such that fluid may be received in and drawn through the at least one inner fluid flow passage past the one or more light sources within the at least one inner fluid flow passage.

35. The implement of claim 20, wherein the at least one tube includes at least one light-transmissive portion, and wherein the at least one light source is positioned for directing light at the at least one light-transmissive portion through which at least some of said light is transmissible and visually perceptible to an observer, whereby the cosmetic appearance of the implement can be enhanced.

36. The implement of claim 20, further comprising one or more indicia highlighted by light from the at least one light source.

37. The implement of claim 36, wherein the one or more indicia are responsive to black light, and the at least one light source includes at least one light source that produces black light for highlighting the one or more indicia.

38. The implement of claim 36, wherein the one or more indicia are etched.

39. The implement of claim 36, wherein the one or more indicia are integrally formed at an acute angle relative to a direction at which light is emitted by the at least one light source.

40. The implement of claim 36, wherein the one or more indicia are printed.

41. The implement of claim 20, wherein at least a portion of the at least one tube is responsive to black light, and wherein the at least one light source includes at least one electric light source that produces black light for highlighting the black light responsive portion of the at least one tube.

42. The implement of claim 20, wherein the at least one light source is housed within at least one housing slidably retained within the at least one inner fluid flow passage such that at least a portion of fluid received in and drawn through the at least one inner fluid flow passage causes slidable movement of the at least one housing and the at least light source housed therein within the at least one inner fluid flow passage.

43. The implement of claim 42, wherein the at least one inner fluid flow passage include first and second portions spaced apart from each other at which the at least inner fluid flow passage is smaller in size, and wherein the at least one housing and the at least one light source housed therein are slidably retained within the at least one inner fluid flow passage between the first and second portions.

44. The implement of claim 42, further comprising electrical terminals external to the at least one housing for electrically-connecting connecting the at least one light source to the at least one power source when the fluid within the at least one inner fluid flow passage electrically connects the terminals to each other.

45. An implement for use in connection with drinking and/or eating, the implement comprising:

at least one tube having at least one inner fluid flow passage therethrough in which fluid may be received and delivered through the at least one inner fluid flow passage;

at least one power source having at least a portion situated in the at least one inner fluid flow passage such that fluid may be received in and drawn through the at least one inner fluid flow passage generally around and past the at least a portion of the at least one power source situation in the at least one inner fluid flow passage;

at least one light source at least partially within the at least one tube and electrically-powered by the at least one power source; and at least one housing rotatably mounted to the at least one tube for rotation in the at least one inner fluid flow passage;

wherein the implement is configured such that rotation of the at least one housing generates electrical power for operating the at least one light source.

* * * * *